US008555576B2

(12) United States Patent
Falk

(10) Patent No.: US 8,555,576 B2
(45) Date of Patent: Oct. 15, 2013

(54) PROFILE FOR THE FACADE OF A MULTI-STOREY BUILDING AND A MULTI-STOREY BUILDING WITH SUCH A FACADE

(75) Inventor: Jon Henrik Falk, Stockholm (SE)

(73) Assignee: Brunkeberg Industriutveekling AB, Stockholm (SE)

( * ) Notice: Subject to any disclaimer, the term of this patent is extended or adjusted under 35 U.S.C. 154(b) by 319 days.

(21) Appl. No.: 12/864,588

(22) PCT Filed: Dec. 11, 2008

(86) PCT No.: PCT/SE2008/051444

§ 371 (c)(1),
(2), (4) Date: Jul. 26, 2010

(87) PCT Pub. No.: WO2009/093948

PCT Pub. Date: Jul. 30, 2009

(65) Prior Publication Data

US 2010/0300021 A1 Dec. 2, 2010

(30) Foreign Application Priority Data

Jan. 25, 2008 (SE) ..... 0800184

(51) Int. Cl.
*E04H 1/00* (2006.01)
*E04B 2/00* (2006.01)
*E04B 1/00* (2006.01)

(52) U.S. Cl.
USPC ..... 52/235; 52/506.06; 52/745.15

(58) Field of Classification Search
USPC ..... 52/235, 200, 201, 208, 204.53, 460, 52/656.2, 656.5, 656.6, 717.01, 745.15, 52/506.06, 236.3
See application file for complete search history.

(56) References Cited

U.S. PATENT DOCUMENTS

| | | | | | |
|---|---|---|---|---|---|
| 3,844,086 | A | * | 10/1974 | Radtke | 52/745.15 |
| 3,978,629 | A | * | 9/1976 | Echols, Sr. | 52/235 |
| 4,418,506 | A | * | 12/1983 | Weber et al. | 52/209 |
| 5,481,839 | A | * | 1/1996 | Lang et al. | 52/235 |
| 5,546,713 | A | * | 8/1996 | Voegele et al. | 52/202 |

(Continued)

FOREIGN PATENT DOCUMENTS

| | | | |
|---|---|---|---|
| DE | 2119184 | A | 12/1971 |
| DE | 19616490 | A1 | 10/1997 |

(Continued)

OTHER PUBLICATIONS

WO 95/13439—Jansson,Borje—May 18, 1995.*

(Continued)

*Primary Examiner* — Ryan Kwiecinski
(74) *Attorney, Agent, or Firm* — Venable LLP; Eric J. Franklin

(57) ABSTRACT

A profile system for fastening of facade elements on a building frame, a building frame including the a profile system and a multi-storey building. The profile system includes a profile of a first kind and a profile of a second kind. The facade elements are arranged in the profile of the first kind and are squeezed in place with the profile of the second kind. The profile of the second kind has a groove that is wider than the thickness of the facade element, so that the facade element can be moved in the groove in the profile of the second kind.

28 Claims, 11 Drawing Sheets

(56) References Cited

U.S. PATENT DOCUMENTS

| | | | | |
|---|---|---|---|---|
| 5,592,795 | A * | 1/1997 | Rinehart et al. | 52/235 |
| 6,151,845 | A * | 11/2000 | Lancaster | 52/198 |
| 7,416,772 | B2 * | 8/2008 | Rinehart et al. | 428/99 |
| 7,594,364 | B2 * | 9/2009 | Rinehart et al. | 52/204.593 |
| 2001/0011444 | A1 * | 8/2001 | Kenny et al. | 52/786.1 |
| 2001/0029708 | A1 * | 10/2001 | Richardson | 52/57 |
| 2003/0226324 | A1 * | 12/2003 | Hogan | 52/235 |
| 2006/0201084 | A1 * | 9/2006 | Arias | 52/235 |
| 2010/0212238 | A1 * | 8/2010 | Voegele et al. | 52/204.595 |
| 2011/0167743 | A1 * | 7/2011 | Ting | 52/235 |
| 2011/0296775 | A1 * | 12/2011 | Dolby et al. | 52/204.6 |

FOREIGN PATENT DOCUMENTS

| | | | |
|---|---|---|---|
| EP | 0534143 | A1 | 3/1993 |
| GB | 2137673 | A * | 10/1984 |
| GB | 2143557 | A | 2/1985 |
| GB | 2391578 | A | 2/2004 |
| GB | 2435652 | A | 9/2007 |
| WO | WO-94/05888 | A2 | 3/1994 |
| WO | WO-95/13439 | A1 | 5/1995 |
| WO | WO-03/062579 | A1 | 7/2003 |

OTHER PUBLICATIONS

PCT/ISA/210—International Search Report—Apr. 21, 2009.

Iris D. Tommelein et al; De-Coupling Cladding Installation From Other High-Rise Building Trades: A Case Study; Proceedings 9th Annual Conference of the International Group for Lean Construction—IGLC 9 Singapore, Aug. 6-8, 2001; pp. 1-12.

Extended European Search Report—Mar. 21, 2013 (Issued in Connection With Counterpart European Patent Application No. 08871516.4).

* cited by examiner

A - A

PROFILE FOR THE FACADE OF A MULTI-STOREY BUILDING AND A MULTI-STOREY BUILDING WITH SUCH A FACADE

CROSS-REFERENCE TO RELATED APPLICATIONS

This application claims priority to Swedish patent application 0800184-4 filed 25 Jan. 2008 and is the national phase under 35 U.S.C. §371 of PCT/SE2008/051444 filed 11 Dec. 2008.

TECHNICAL FIELD

The present invention relates to a profile system for supporting plate formed facade elements on a multi-story building and to a multi-storey building provided with such a profile system.

DESCRIPTION OF THE PRIOR ART

Multi-storey buildings may be constructed in a plurality of ways. Common for all of them is that they comprise a facade. The facade may be provided in a large number of different ways and may either constitute a load bearing part of the multi-storey building or only serve as weather protection. In the latter case the building comprises a building frame on which plate formed facade elements are attached. The plate formed facade elements may comprise one or more different kinds of facade elements. The facade elements may comprise one or more glass plates, thermopanes or laminated glass, one or more weatherproof plates or a combination of glass plates and weatherproof plates and may also comprise a frame which holds the glass plates and/or the weatherproof plates. With isolation glass is usually meant facade elements with two or more glass plates attached to each other with intermediate air- or gas filled spaces. The facade may also comprise double sets of facade elements with an intermediate space in which air can circulate, so called double-shell facades. The facade elements may also comprise isolation on the inside of the weatherproof plates. The weatherproof plates may be constituted by for example metal plates, plastic plates or composite plates. A combination of different plate formed facade elements may be used for the facade.

In the international patent application WO03/062579 a glass cover system for buildings is described, wherein a number of glass module elements are arranged to be connected with frame parts which are part of the building. The purpose of the invention is to achieve retainment of the glass elements and to hinder these from tipping inwards or outwards due to forces which affects the glass elements. To this end the module elements are provided with connection units which are premounted on the frame parts of the elements. On the connection units handling units are attached before the facade elements are lifted on place, as it is desired to avoid as long as possible to need to handle the glass plates with the heavy handling units in place. Before the glass plates are put in place attachment means have also been arranged on the frame parts in which the handling units can be attached.

The international patent application WO 95/13439 describes a glassing system for buildings, wherein the system comprises glass elements with at least two at a distance from each other joined panes of glass so that grooves are formed between the panes of glass. The elements are arranged to be mounted on a frame by means of fastening elements which extends into the grooves which are formed between the panes in a glass element. The fastening element is in turn fastened in the frame by means of screws which afterwards are covered with a jointing compound to fill the joint between adjacent facade elements. In order to distribute the jointing compound a strip with a U-formed part is pushed into the groove so that the U-formed part will enclose parts of the edge of the inner glass plate. During the insertion the jointing compound will be pressed out so that a good sealing is provided.

In EP 0534143 it is described how vertical supporting parts are arranged along vertical pillars to support horizontal U-formed parts arranged along horizontal girders for supporting facade elements. The U-formed parts are arranged to guide water to the vertical supporting parts which are arranged so that water may flow down in shafts arranged for the purpose.

In WO 94/05888 a module for fastening a double glass facade against a supporting structure is described. The module comprises a frame of stainless steel provided with a seam to receive an edge of the double glass facade and a stiffer part for fixation of the frame and the glass in the support structure. In order to enable direct attachment in the support structure the stiffer part of the frame is guided by means of a stainless spring which constitutes a leg on the support structure.

The facade elements must be attached on the building frame in any suitable way so that the facade elements are kept on place and so that the facade becomes windtight and watertight so that a weather protection is provided. This is a complex handling and it is therefore of utmost importance to arrange a simple way of fastening the facade elements against the building frame. It may also be an advantage to be able to easily loose an attached facade element from the building frame if this would have to be exchanged at any time.

The handling of the facade elements during mounting in the building frame is sensitive and facade elements may be damaged during handling. During hoisting of facade elements there is risk for the elements to hit into earlier mounted elements or other parts of the building or nearby equipment and damages may arise. These risks increase during mounting in hard wind, which may lead to a stand-still in the building while awaiting calmer weather.

The facade elements are usually lifted to the correct height on the facade using building cranes which have the purpose of lifting building material to different parts of the building. The building cranes are often highly loaded which makes the coordination between the lifting for different working operations very important. The time that a building crane is busy with a specific facade element runs from that a facade element is hooked onto the building crane down on the ground until the facade element has been attached to the building frame and the facade element may be disconnected from the building crane. Thus, the time it takes to attach the facade element in the building frame effects the time that the building crane is busy with the facade element.

In "De-coupling cladding installation from other high-rise building trades: a case study, proc. 9$^{th}$ Annual conference of the International group for lean construction—IGLC 9, Singapore, 6-8 Aug. 2001", a method for hoisting facade elements on a multi-storey building without the use of building cranes is described. For hoisting of facade elements one or more cranes are described which can successively be placed on the floors during the erection of the building and which comprises supports for a cable guided lifting device in which the facade element may be transported to the desired height in the building. The facade elements can then be distributed horizontally to the desired place using a traverse collar arranged to be temporarily anchored on the building frame around the entire building and which may be moved continuously upward in the building. After finishing mounting of facade elements all parts which have been intended for hoisting and distribution of facade elements to the intended place will be dismantled and may thereby not be used for other purposes regarding the building.

DESCRIPTION OF THE INVENTION

An object of the present invention is to provide a profile system for attachment of facade elements on a building frame and a multi-storey building with such a profile system, which profile system implies a simplified mounting of facade elements, possibilities to also dismantle the facade elements in a simple way and improved vertical transport of facade elements to the place on which they are to be mounted.

Another object of the present invention is to provide a profile system for attachment of facade elements on a building frame and a multi-storey building with such a profile system, which profile system allows a fastening of facade elements on the building frame in a way which is less weather dependent than the prior art.

A further object of the present invention is to provide a profile system for fastening of facade elements on a building frame and an multi-storey building with such a profile system, which profile system allows a fastening of facade elements on the building frame in a way which to a lesser extent than prior art techniques needs to use building cranes.

At least one of the above objects is achieved with a profile system and a multi-storey building.

A basic idea with the present invention is to provide a profile system which enables controlled hoisting of facade elements together with fastening of the facade elements.

A profile system according to the invention is intended for supporting plate formed facade elements on a building frame. The plate formed facade elements have two main sides, two essentially parallel edge sides and a thickness between the main sides perpendicularly to the main sides. The profile system is characterised in that it comprises a profile of a first kind with a length axis, which profile has a cross section which is essentially constant along the length axis. The profile of the first kind comprises a first portion comprising a first inner surface and second portion comprising a first inner surface, which inner surfaces are facing each other, and a waist extending from the first portion to the second portion. The first portion is arranged to be mounted against the building frame with the first inner surface of the first portion facing away from the building frame. A facade element is arranged to be supported by the first inner surface of the first portion. The profile system also comprises a profile of a second kind with a length axis, which profile has a cross section which is essentially constant along the length axis. The profile of the second kind comprises a first portion which is arranged to be placed so that it supports the facade element, a second portion which is arranged to be placed against the first inner surface of the second portion of the profile of the first kind, and a waist which connects the first portion with the second portion, wherein a groove is defined in the profile of the first kind by the first portion, the second portion and the waist.

By designing the profile system with a profile of a first kind intended to be mounted against the building frame and where the facade element at one of its edge sides may be supported by the inner surface of the first portion on the profile of the first kind and a profile of a second kind which is mounted after the facade element has been placed against the profile of the first kind, a very simple mounting of the facade element may be achieved, which does not require any special methods in order to attach the facade elements or to fit parts mounted on the elements against special fastening devices on the profile system or to glue the elements in place.

The mounting of the profile of the first kind against the building frame may also comprise that the profile of the first kind is mounted against a girder or similar which is mounted against the building frame, for example when the profile of the first kind comprises a part of a profile system which holds the outer facade element in a double-shell facade.

A profile system according to the invention gives a good support for the facade elements and allows facade elements of different sizes and also very large facade elements to be used in the building of the facade of the building.

The profile of the second kind of the profile system is designed to provide a good fastening of the facade element when it is placed against the profile of the first kind and the facade element and to provide a groove in the profile system in the vertical direction.

With a profile system according to the invention guidance is provided for the facade element when it is hoisted up the facade. More specifically, one of the edge sides may be guided by the groove in any profiles of the second kind which have already been placed on the profile of the first kind in order to press an earlier mounted facade element and by the groove in the profile of the first kind which is created by the first inner surface on the first portion and the first inner surface on the second portion.

The width of the groove may be larger than the thickness of the facade element, so that the facade element may run in the groove or so that the facade element may be provided with a guidance member that during hoisting can run in the groove. It is preferably facade elements which have so called double-shells and thereby are relatively thick, that are provided with guidance members for hoisting in order to avoid that the groove has to be made so large that the double shell element may run with its entire thickness in the groove.

Preferably, the profile system is arranged with a profile of the first kind for each one of the edge sides on the facade element, wherein the profiles of the first kind are arranged parallel with each other so that the edge sides on the facade element get support on each one of the edge sides.

Each profile of the first kind may be common to several facade elements vertically placed on top of each other.

Preferably, a pair of profiles of the second kind are arranged for each one of the facade elements with a profile of the second kind for each edge side. In that way each facade element may be squeezed into place separately with the profiles of the second kind. This also results in that the facade elements may be removed separately from the building frame if they need to be replaced.

Preferably, the profiles of the first kind are arranged vertically. Such an arrangement results in that the facade elements easily may be hoisted with minimal friction between the facade elements and the profiles of the second kind.

The first inner surface of the second party on the profile of the first kind may be plane. This results in that the profile of the second kind relatively easy may be adapted to lie against the whole of said inner surface. It is possible to arrange dents in the surface so that the profile of the second kind is snap locked to the profile of the first kind when it is arranged to press a facade element in place.

The perpendicular to the first inner surface of the second portion on the profile of the first kind is partly directed away from the waist of the profile of the first kind. This means that the distance between the first inner surface of the first portion and the first inner surface of the second portion increases with increasing distance from the waist. This results in that it is easier to insert the profile of the second kind between the facade element and the first inner surface of the second portion.

A sealing strip may be arranged on the first inner surface of the first portion on the profile of the first kind in order to seal between the first inner surface of the first portion on the profile of the first kind and the facade element.

The sealing strip may alternatively be mounted on the building site in connection with the arrangement of the facade elements.

The first portion of the profile of the first kind may be made of metal. In the corresponding way the second portion of the profile of the first kind may be made of metal. Metal may have many preferable properties such as high strength and durability. Some metals are also suitable for extrusion which is a favourable manufacturing process in manufacturing of profiles with a constant cross section. Aluminium and aluminium based alloys are examples on metals which are suitable to use, but also other materials may be used.

Heat is conducted through the facade through the facade elements or through the profiles of the first kind. The facade elements may with known techniques be manufactured so that they have good heat isolation properties. In order to minimize the heat conduction through the profile of the first kind the waist of the profile of the first kind may at least partly be made of a heat isolating material. The heat isolating material may for example comprise plastic and is preferably made of fibre reinforced plastic. The heat isolating material is preferably chosen so that it may be extruded.

It is not necessary to let the entire waist be of a heat isolating material. The waist of the profile of the first kind closest to the first portion may be made of a heat isolating material while the rest of the waist may be made of metal. This is preferable in that the waist at a distance from the first portion may constitute fastening point for the profiles of the second kind. Furthermore, the portion closest to the first portion is adjacent to the facade element when it is mounted. The heat isolating material may be designed to serve as sealing on the side edges of the facade element.

The second portion of the profile of the first kind may have an outer surface which is facing away from the first inner surface of the second portion, wherein the profile of the first kind comprises at least one rack which is arranged on the other surface. The rack may be used to drive for example a hoisting device on the profile.

By using a hoisting device which uses said rack for hoisting the use of a building crane for hoisting facade elements may be avoided. Thus the subcontractor which is responsible for the facade does not have to coordinate the deliveries of or the hoisting of the facade elements with the operator of the building crane.

As the hoisting and mounting is performed from the outside of the multi-storey building a minimal space is required for the facade elements on each floor. This results in the work on the facade intruding minimally on the work of other contractors in the multi-storey building.

Furthermore, each floor is loaded less than according to the prior art when no facade elements need to be stored on the floors. This results in that the facade elements may begin to be arranged on the facade before the concrete has reached its full strength.

Said at least one rack may be arranged in a groove on the outer surface of the profile of the first kind. By arranging said at least one rack in a groove it is protected from damage from the outside.

The profile of the first kind may comprise a supporting profile which extends from the outer surface of the second portion, which supporting profile comprises a profile surface which is facing the outer surface of the second portion on the profile of the first kind. Such a supporting profile may serve as support for a hoisting device which is to be driven on the outside of the facade.

The first portion of the profile of the first kind may comprise a second inner surface and the second portion may comprise a second inner surface, wherein a second facade element is arranged to be supported at one of its edge sides by the second inner surface of the first portion, wherein the first inner surface and the second inner surface of the first portion are arranged on opposite sides of the waist, and wherein the first inner surface and second inner surface of the second portion are arranged on opposite sides of the waist which profile system also comprises a second profile of the second kind which is arranged to be placed so that the first portion supports the second facade element and the second portion is placed against the second inner surface of the second portion on the profile of the first kind. Such a profile may be made symmetrical with regard to the waist which is preferable when the profile is to be used to attach facade elements in multiple columns and multiple rows on a facade, as each profile of the first kind then may hold a facade element on each side.

The profile of the first kind may be arranged so that the first facade element and the second facade element essentially end up in the same plane when they are arranged in the profile of the first kind. Such a profile of the first kind is suitable for joining the facade elements which both constitute a part of a larger essentially plane portion on a multi-storey building.

The profile of the first kind may be arranged so that the first facade element and the second facade element essentially end up in an angle in relation to each other when they are arranged in the profile of the first kind. Such a profile of the first kind is suitable for joining two facade elements which are to be arranged in an angle in relation to each other, such as at a corner on the building.

The profile of the first kind may be symmetrical with regard to a symmetry axis which runs through the waist.

The profile of the second kind may have an essentially U-formed cross section, wherein the waist of the profile of the second kind is arranged to rest against the waist of the profile of the first kind in its mounted position. By letting the profile of the second kind rest against the waist the profile of the second kind gets stably arranged.

The plate formed facade elements comprise an upper edge side and a lower edge side which may be essentially parallel to each other and which may comprise grooves.

The upper edge side and the lower edge side may be arranged to be placed essentially horizontally. This is advantageous in that the arrangement of them of the facade then is facilitated.

The profile system may comprise a separable T-profile, which has a length axis and an essentially constant cross section along the length axis, and which is arranged to interact with grooves in the upper edge side and the lower edge side, wherein a first part of the separable T-profile comprises a waist and a first portion of a flange which first portion extends from a first flange edge to the waist, wherein a second part of the separable T-profile comprises a second portion of the flange which portion extends from a second flange edge to the waist, and wherein the waist extends from the flange away from the waist. Such a T-profile facilitates the arrangement of the facade elements on the facade. At the same time such a T-profile facilitates the exchange of individual facade elements.

The parts in the separable T-profile may be arranged to be fastened in the building frame with at least one screw which extends through the first part of the T-profile and the second part of the T-profile as well as the waist of the T-profile. Such an arrangement makes the arrangement of the T-profile easy with a small number of fastening members.

Each one of the parts of the T-profile may comprise a contact surface with at least one step in the interface between the parts. With such a contact surface a well defined contact between the parts of the T-profile is provided.

According to a second aspect of the present invention a facade system is provided comprising plate formed facade elements and a profile system according to the first aspect of the present invention. With such a facade system the facing of a building frame is enabled in order to provide a multi-storey building.

According to a third aspect of the present invention a building frame for multi-storey buildings comprising a profile system according to the above is provided.

Preferably, at least two profiles of the first kind are arranged on the building frame. The profiles are arranged with their length axes parallelly to each other, wherein the profiles are arranged for reception of a facade element between them.

Preferably, the profiles are arranged with their length axes vertically as such an arrangement gives the least friction when hoisting the facade elements.

According to a fourth aspect of the present invention a multi-storey building is provided. A multi-storey building according to the invention comprises a building frame according to the above description, comprising a plurality a facade elements which are arranged on the building frame.

According to a fifth aspect of the present invention a method is provided for arrangement of plate formed facade elements on a building frame, wherein the plate formed facade elements have two main sides, two essentially parallel edge sides and a thickness between the main sides perpendicularly to the main sides. The method is characterized by the step of arranging at least a first and a second profile of a first kind, which profiles each comprise a length axis, on a building frame with their length axes parallel to each other and having a cross section which is essentially constant along the length axis. The profile of the first kind comprises a first portion comprising a first inner surface and a second portion comprising a first inner surface, which inner surfaces are facing each other and a waist which extends from the first portion to the second portion, wherein the first portion is arranged against the building frame with the first inner surface of the first portion facing away from the building frame. The method is also characterized by the step of arranging a facade element so that it is supported at one of its edge sides by the first inner surface of the first portion on the first profile of the first kind and at its second edge side by the first inner surface of the first portion on the second profile of the first kind. The method is characterized by the step of arranging a profile of the second kind, which profile has a length axis and a cross section which is essentially constant along the length axis, at each one of the profiles of the first kind. The profiles of the second kind comprises a first portion which is placed so that it supports the facade element, a second portion which is placed against the first inner surface of the second portion on the profile of the first kind, and a waist which connects the first portion with the second portion, wherein a groove is defined in the profile of the second kind by the first portion, the second portion and the waist. The width of the groove between the first portion and the second portion is larger than the thickness of the facade element. Alternatively, the facade element is provided with a guidance member arranged to be placed in the groove for guidance of the facade element during hoisting. The width of the groove may in this case be made smaller than the thickness of the facade element. This may be advantageous during handling of facade elements in the form of facade cassettes comprising a plurality of glass elements arranged on the outside of each other, which results in that facade elements get a wide side, this may be valid for example for double glass facade elements. During fastening of facade elements in the form of facade cassettes the length of the profile on the profile of the first kind and the length of the inner part of the profile of the second kind will be adapted.

A method according to the fifth aspect of the present invention provides an advantageous method for arrangement of facade elements on a building frame.

In a method according to the invention the plate formed facade elements may comprise an upper edge side and a lower edge side which are essentially parallel to each other and which comprise grooves. With grooves on the lower edge side and the upper edge side the fastening of the facade element on the building frame is facilitated as the facade elements then may be hindered from moving outwards from the building frame as well as inwards towards the building frame with a common profile which is arranged in the groove. Such facade elements are usually thermopane elements which comprise two glass plates between which the frame made of for example aluminium or plastic, is arranged. The frame and the glass plates define a space in which a gas, such as for example dry air or a noble gas, may be arranged. The grooves may be arranged directly in the frame or be arranged in a frame arranged on the outside which encloses and protects the facade element.

The method can also comprise the step of arranging, before the arrangement of the facade element, a first separable T-profile at the lower edge of the facade element, which T-profile has a length axis and an essentially constant cross section along the length axis, and which is arranged to interact with the grooves in the upper edge side and the lower edge side.

A first part of the separable T-profile comprises a waist and a first portion of a flange which first portion extends from a first flange edge to the waist, wherein a second part of the separable T-profile comprises a second portion of the flange, which portion extends from a second flange edge to the waist and wherein the waist extends from the flange away from the flange so that the first portion of the flange is directed upwards. The method may also comprise the step of arranging a first part of a second separable T-profile, which has the same construction as the first separable T-profile, in the upper edge of the facade element, so that the first portion of the flange is directed upwards. When arranging the facade element the first portion of the flange may be arranged on the first separable T-profile in the groove in the lower edge of the facade element. The method may also comprise the step of arranging, after the arrangement of the facade element, the second part of the second separable T-profile, so that the second portion of the flange on the second separable T-profile is placed in the groove in the upper edge of the facade element.

Such an arrangement of the T-profile is favourable as a facade element, which in the vertical direction is placed between two other facade elements, easily may be exchanged without affecting the facade elements which are placed on both sides of the facade element to be exchanged.

The method may also comprise the step of arranging a second facade element so that the first portion of the flange on the second separable T-profile is placed in the groove in the lower edge of the second facade element. Thereby, each T-profile holds both in the upper edge of a first facade element and in the lower edge of a second facade element.

The method may comprise the step of hoisting the second facade element in the groove in the profiles of the second kind which supports the first facade element. Thereby a guidance of the facade element is provided during hoisting to the position in which they are to be mounted.

The second portion of the profile of the first kind may have an outer surface which is facing away from the first inner surface of the second portion, wherein the profile of the first kind comprises at least one rack which is arranged on the outer surface, and wherein the facade elements are moved up to the correct height by using the rack. By the use of an integrated rack to hoist the facade elements the use of cranes arranged on the house roof is avoided for this purpose.

In the following preferred embodiments of the invention will be described with reference to the appended drawings.

SHORT DESCRIPTION OF THE DRAWINGS

DESCRIPTION OF PREFERRED EMBODIMENTS OF THE INVENTION

Figure 1:
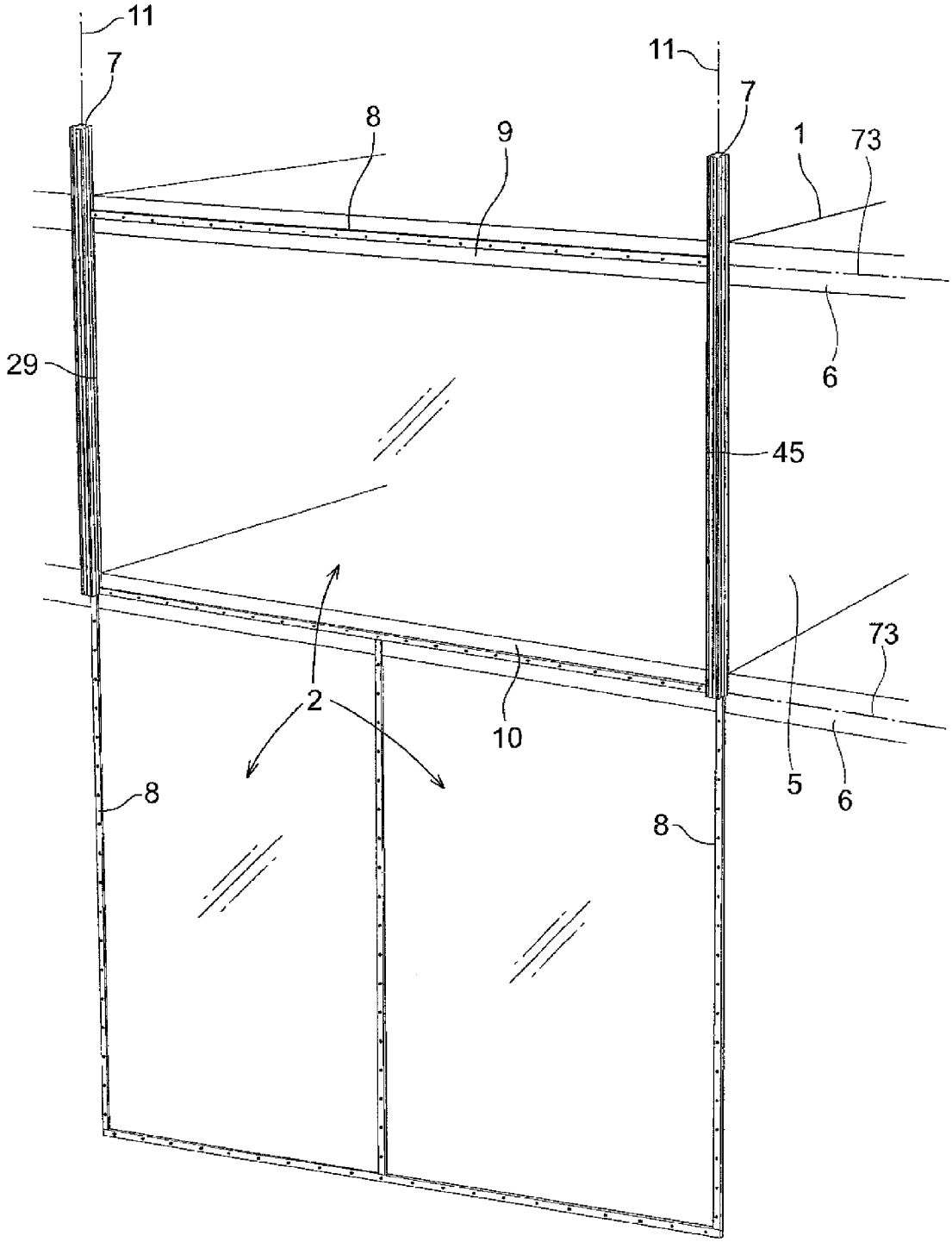
FIG. 1 shows a perspective view of a part of a building frame on which facade elements are mounted with the profile system according to an embodiment of the present invention.

In the following description of preferred embodiments of the invention similar parts in different figures will be denoted by the same reference numeral.

FIG. 1 shows a perspective view of a part of a building frame 1, on which a facade element 2 is mounted using the profile system according to an embodiment of the present invention. The facade elements 2 are in the shown embodiment a glass plate. The facade elements 2 comprise a first main side 3 and a second main 4 (FIG. 2), which are essentially parallel to each other. The facade elements comprise also a first edge side 29 and a second edge side 45. The building frame 1 comprises a number of vertical, load bearing walls 5 as well as a number of horizontal, between the walls 5 extending floors 6. On the facade profiles of a first kind 7 are arranged essentially vertically. In the figure two parallelly arranged profiles of the first kind 7 are shown. A facade element 2 is arranged in the two parallel profiles of the first kind 7. The profile system also comprises a separable T-profile 8 with a length axis 73, with which T-profile 8 the facade element 2 is fastened in the building frame 1 at its upper edge side 9 and its lower edge side 10. The T-profile 8 will be described in larger detail below. In FIG. 1 is also shown the length axis 11 for the profile of the first kind. Below the facade element 2, which is fastened in the two parallel profiles of the first kind 7, there is arranged two facade elements 2 which are arranged rotated 90° in relation to the facade element between the profiles of the first kind. The two lower facade elements 2 are on all sides fastened by means of separable T-profiles 8.

As is evident from the figure the profiles of the first kind ends at the lower edge of the facade element 2 which is arranged between the profiles of the first kind 7. This allows the facade elements to be inserted into the profiles of the first kind 7 from below. How a facade element 2 may be inserted into the profiles of the first kind will become more clear from the following description.

Figure 2:
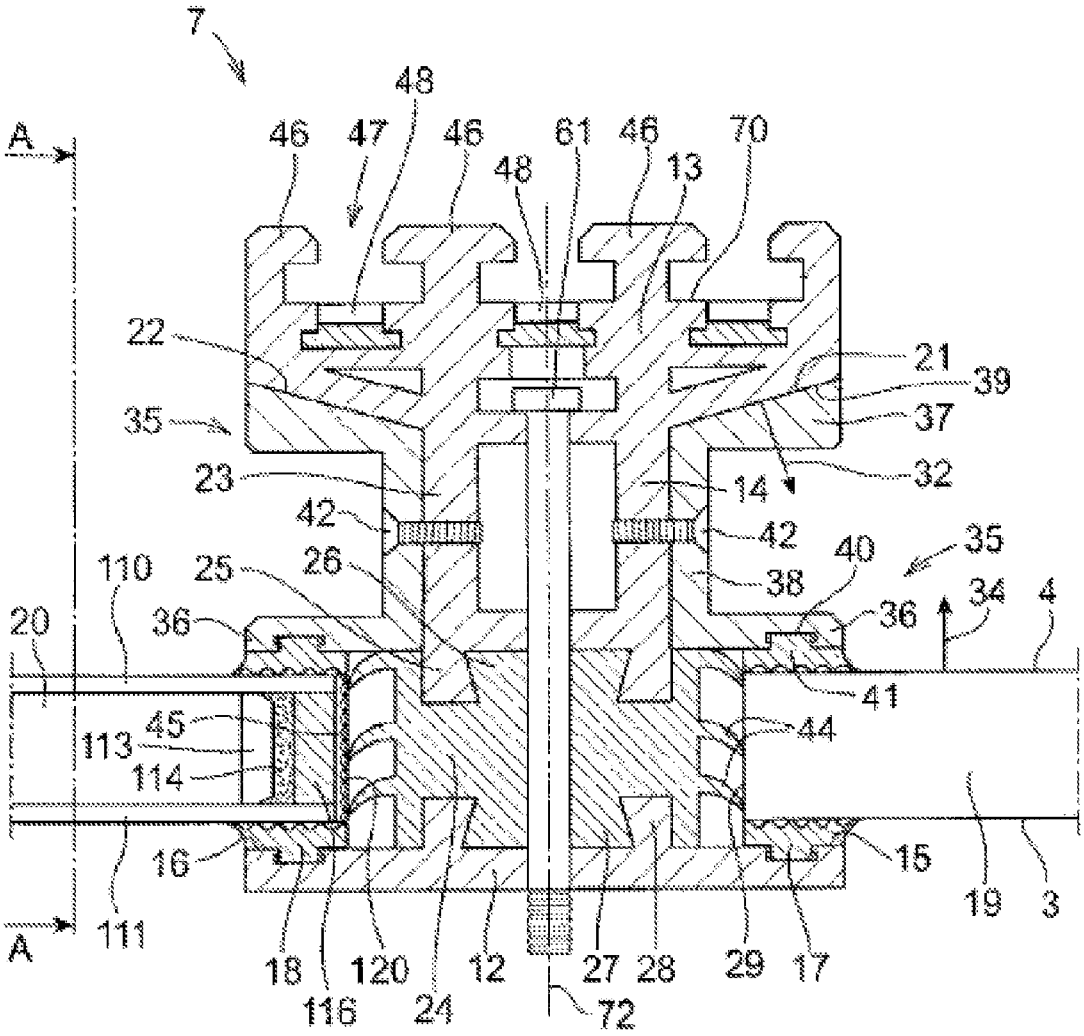
FIG. 2 is a cross-sectional view from above of the profile system according to an embodiment of the present invention.

FIG. 2 is a cross-sectional view from above of the profile system according to an embodiment of the present invention. In FIG. 2 the profile of the first kind 7 is shown, which profile has a cross-section which is essentially constant along the length axis 11. The profile of the first kind 7 in principle has the form of an H. The profile of the first kind 7 comprises a first portion 12, which is arranged to be placed facing the building frame 1, a second portion 13 which is arranged to be placed facing away from the building frame and a waist 14 which connects the first portion 12 with the second portion 13. The first portion 12 is made of metal and comprises a first inner surface 15 and a second inner surface 16 which are facing away from the building frame 1 and which are arranged on opposite sides of the waist 14. On the first inner surface 15 there is arranged a first sealing strip 17 and on the second inner surface 16 there is arranged a second sealing strip 18. A first facade element 19 is arranged to rest against the first sealing strip 17 and to be supported by the first inner surface 15. A second facade element 20 is arranged to rest against the second sealing strip 18 and to be supported by the second inner surface 16. The first facade element 19 comprises a first edge side 29 which is arranged at the first inner surface 15. The first facade element 19 comprises also a first main side 3 which is facing the building frame 1 and a second main side 4 which is facing away from the building frame. The profile of the first kind is symmetrical with respect to the symmetry axis 72 which extends through the first portion 12, the second portion 13 and the waist 14.

The first facade element is only shown schematically and may for example comprise metal plates with isolation in between. The second facade element 20 is a so called thermopane and comprises a first pane of glass 110 and a second inner pane of glass 111. Between the panes of glass 110, 111, there is arranged a spacing strip 116 made of massive polymer. Between the panes of glass 110, 111, arranged on the inside of the spacing strip in relation to the low edge side 10 there is arranged a jointing compound 114 and a drying strip 113. Inside the jointing compound 114 and the drying strip 113 and between panes of the glass 110, 111 there is arranged a gas which for example may be argon or krypton.

On the edge side 45 of the second facade element 20 there is arranged a thin plastic cover 120 which may be grooved on the edge side 45. The grooves on the plastic cover 120 may interact with the sealing flanges 44 so that the second facade element 20 is kept in place by the interaction between the sealing flanges 44 and the grooves on the plastic cover 120. The grooves may also be arranged directly on the edge side 29 on a facade element. The plastic cover 120 protects the edges on the panes of glass 110, 111.

The second portion 13 comprises a first inner surface 21 and a second inner surface 22 which are facing against the building frame 1 and which are arranged on opposite sides of the waist 14. The waist 14 comprises a first part 23 of metal which first part 23 forms a continuous unit with the second portion 13. The waist comprises also a second part 24 which is of a heat isolating material such as some plastic. The second part 24 is connected to the first part 23 by means of a first mechanical connection which comprises a first set of trapeziformed studs 25 in the first part 23 and a second set of trapeziformed studs 26 in the second part 24, wherein the first set of trapeziformed studs 25 and a second set of trapeziformed studs 26 are adapted to each other so that they create a safe connection perpendicularly to the length axis 11. The second part 24 is connected to the first portion 12 by means of a second mechanical connection which comprises a third set of trapeziformed studs 27 in the second part 24 and a fourth set of trapeziformed studs in the first portion 12. The perpendicular 34 to the second main side 4 of the first facade element 19 is not parallel to the perpendicular 32 to the first inner surface 21 of the second portion 13. The perpendicular 32 to the first inner surface 21 of the second portion 13 is facing away from the waist 14 on the profile of the first kind.

A first profile of the second kind 35 is arranged between the first facade element 19 and the first inner surface 21 of the second portion 13 on a profile of the first kind 7. The first profile of the second kind 35 comprises a first portion 36 which is arranged to be placed so that it supports the first facade element 19 as is shown in FIG. 2. The first profile of the second kind 35 comprises also a second portion 37 which is arranged to support against the first inner surface 21 on the second portion 13 on the profile of the first kind. It is not necessary to have the first inner surface 21 plane as is shown in the figure. The first inner surface 21 may be provided with dents which are designed so that it is possible to insert the profile of the second kind 35 towards the profile of the first kind during mounting of the profile of the second kind. The first profile of the second kind 35 comprises also a waist 38 which extends from the first portion 36 to the second portion 37. The waist 38 on the first profile of the second kind is arranged to abut the waist 14 on the profile of the first kind 7. The second portion 37 on the first profile of the second kind 35 has an outer surface 39 which abuts the first inner surface 21 on the second portion 13 on the profile of the first kind 7. The first portion 36 on the first profile of the second kind 35 has an outer surface 40 on which there is arranged a third sealing strip 41 which is arranged to abut the second main side 4 on the first facade element. The first profile of the second kind 35 is attached to the waist 14 on the profile of the first kind 7 by means of one or more countersinked screws 42. In FIG. 2 is also shown that the first edge side 29 on the first facade element 19 is in contact with deformable sealing flanges 44 on the heat isolating second part 24 of the waist 14.

The first profile of the second kind 35 also forms a groove which is formed by the first portion 36, the second portion 37 and the waist 38. The width of the groove between the first portion 36 and the second portion 37 is larger than the thickness of the facade element 19 between the main sides 3, 4. This results in that a facade element may be moved up along the profiles of the first kind guided by the grooves in profiles of the second kind 35. Thus the facade element 19 may be arranged on a building frame starting from below. Thanks to the profile of the second kind 35 being attached to the waist 14 of the profile of the first kind 7 by means of one or more countersinked screws 42 the screws 42 will not be hindering during hoisting of facade elements 19.

In the description above the fastening of a facade element 19 at its first edge side 43 has been described. The fastening of the facade element is made in the corresponding way at its second edge side which corresponds to the second edge side 45 on the second facade element 20 which is shown in FIG. 2.

When a facade element 19 is to be put on place it is guided during the hoisting by the grooves in the underlying profiles of the second kind 35. When the facade element 19 has come to the correct level the facade element is moved into contact with the first sealing strip 17, wherein the deformable sealing flanges 44 on the second part 24 of the waist 14 are deformed. Then the profile of the second kind 35 is arranged between the facade element and the second portion 13 on the profile of the first kind 7. Thanks to the inclined first inner surface 21 of the second portion 13 on the profile of the first kind the pressure against the facade element will increase when the waist 38 on the profile of the second kind 35 is tightened against the waist 14 on the profile of the first kind 7. By adapting the dimensions on the profile of the second kind and the thickness on the first sealing strip and the third sealing strip 41 to the distance between the first inner surface 15 on the first portion on the profile of the first kind 7 and the first inner surface 21 on the second portion on the profile of the first kind 7, a suitable pressure force may be provided on the facade element 19.

As is shown in FIG. 2 the profile of the first kind 7 comprises also an outer surface 70 on which there may be arranged a plurality of supporting profiles 46 between which grooves 47 are arranged. In the grooves 47 racks 48 have been arranged. The racks 48 and the supporting profiles 46 may be used to drive one or more hoisting devices (not shown) that may be used to hoist facade elements 19, 20. The racks may be removed by moving them along the length axis of the profile 7. The supporting profiles exhibits profile surfaces 49 which are facing the second portion of the profile of the first kind.

Figure 3:
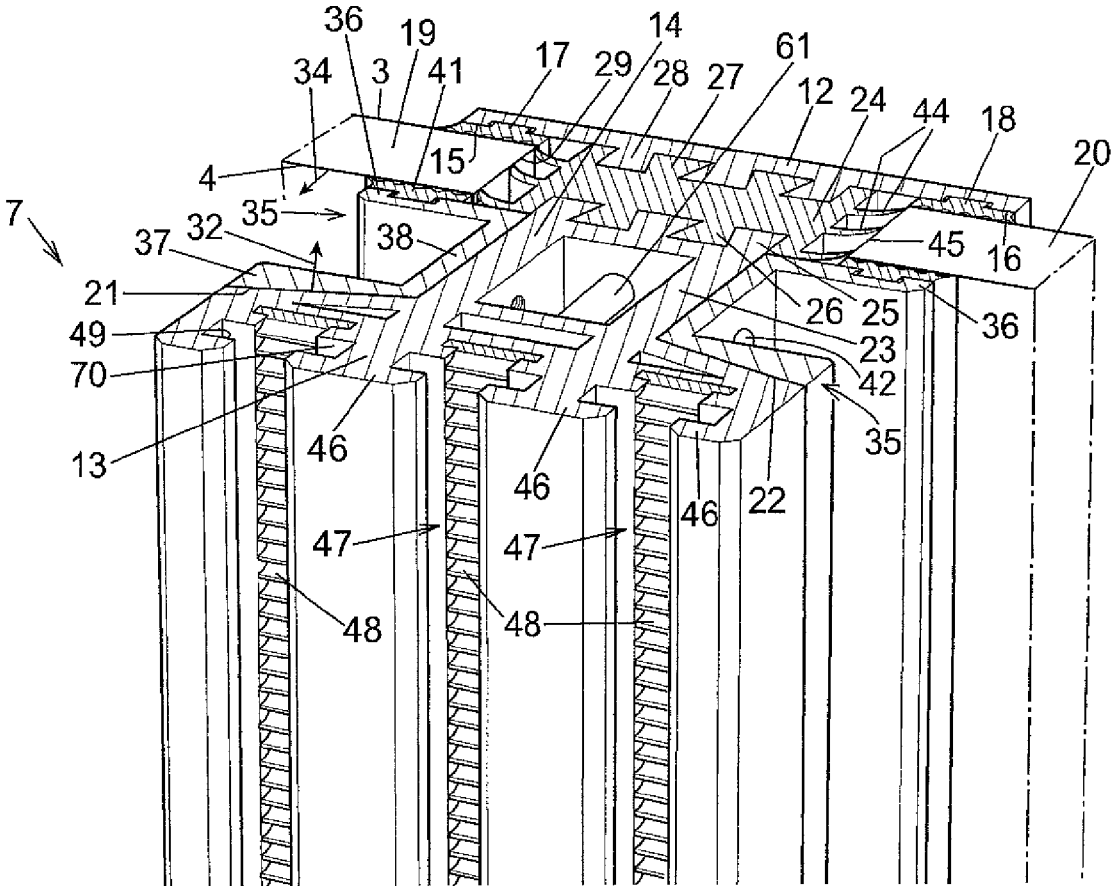
FIG. 3 is a perspective view of the profile system in FIG. 2.

The profile of the first kind is arranged pressed against the building frame (not shown in FIG. 2) by means of screws 61 whose threaded part is shown in FIG. 3 and the screw heads of which are arranged behind one of the racks 48. After the screws have been tightened into the building frame the rack 48 in the middle is arranged in its groove 47. Thereby the screw 61 will be concealed. With building frame is meant a load bearing part of the building or a part which is fastened in a load bearing part of the building frame.

FIG. 3 is a perspective view of the profile system in FIG. 2. No further essential features are shown in FIG. 3 which are not shown in FIG. 2. However, the design of the racks 48 is evident from FIG. 3.

Figure 4:
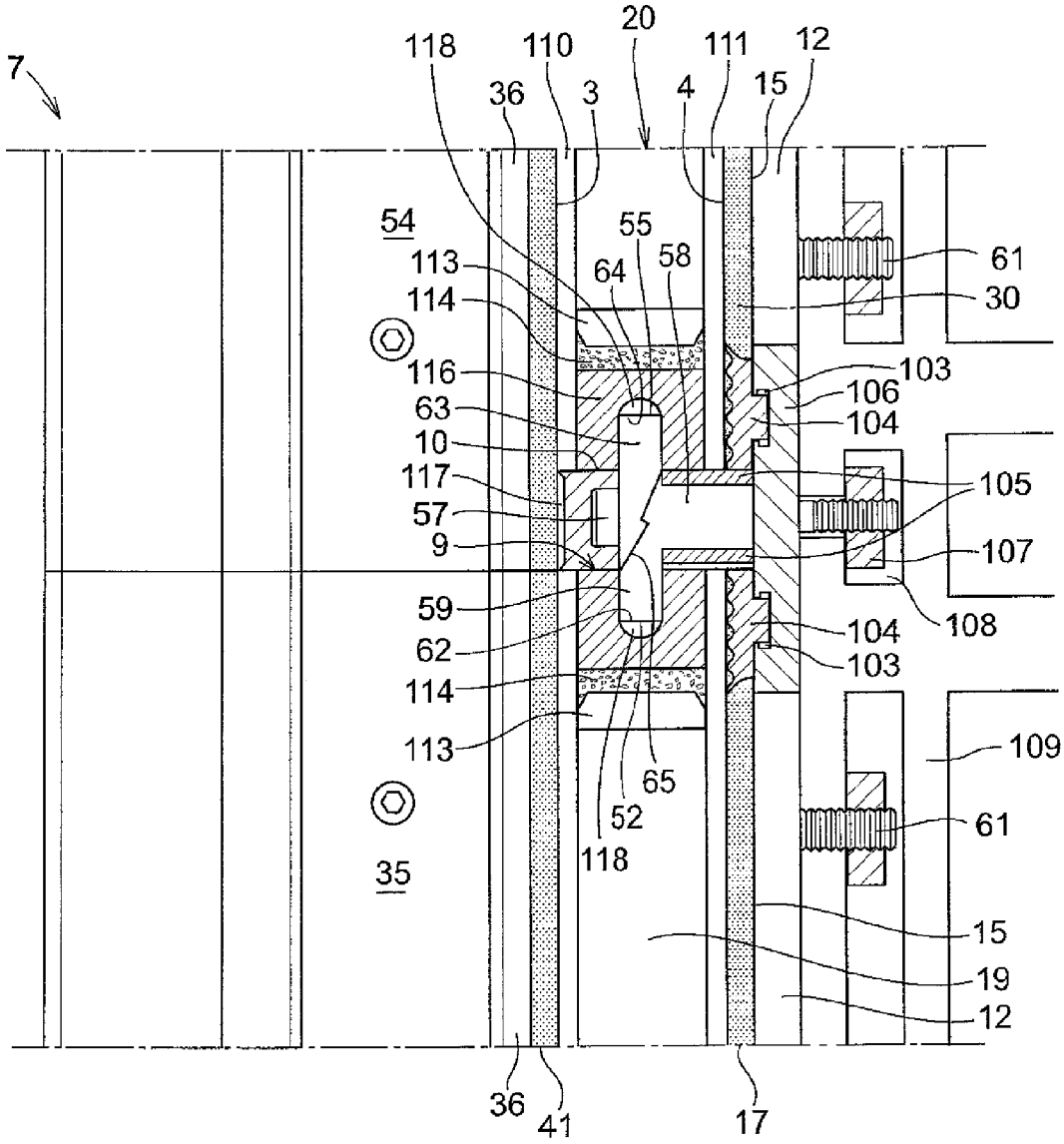
FIG. 4 is a view from the side which shows the fastening of the facade elements in their upper edge and lower edge.

FIG. 4 is a view from the side which shows fastening of a first facade element 19 in its upper edge and fastening of a second facade element 20 in its lower edge. The first facade element 19 rests against the first sealing strip 17 which is arranged on the first inner surface 15 of the first portion 12 on the first profile of the first kind 7. A first profile of the second kind 35 is arranged as has been described above so that a third sealing strip 41 rests against the first facade element 19 and thus holds the first facade element 19. The second facade element 20 is in a corresponding way squeezed in between the first profile of the first kind 7 and a second profile of the second kind 54. The facade elements are so called thermopanes and comprise a first pane of glass 110 and a second inner pane of glass 111. Facade elements in the form of thermopanes will be described with reference to the second facade element 20. Between the panes of glass 110, 111, there is arranged a distance strip 116 which may be made of massive polymer or of any metal. The distance strip 116 in the lower edge side of the facade elements comprises a lower groove 55. In the corresponding way the first facade element 19 comprises an upper groove 52 in its upper edge side 10. Between the panes of glass 110, 111, arranged on the inside of the distance strip 116 in relation to the lower edge side 10, there is arranged a jointing compound 114 and a drying strip 113. On the inside of the jointing compound 114 and the drying strip 113 and between the panes of glass 110, 111, there is arranged a gas which for example may be argon or krypton. A separable T-profile is arranged tightened into the building frame, which in this case is comprised of a fastening profile 109 which in itself is not load bearing, by means of a screw 57. In the fastening profile 109 there is arranged a mounting groove 108 in which a nut 107 is arranged. A first part of the separable T-profile comprises a waist 58 and a first portion 59 of a flange which extends from a first flange edge 62 to the waist 58. The first flange edge 62 and parts of the first portion 59 of the flange are arranged in the upper groove 52 while the end of the waist which is facing away from the flange is facing the building frame (not shown in FIG. 3). A second part of the separable T-profile comprises a second portion 63 of the flange which extends from a second flange edge 64 to the waist 58. The second flange edge and parts of the second portion 59 of the flange are arranged in the lower groove 55.

On the fastening profile 109 there is arranged a profile 106 with grooves 103 for sealing strips 104 which are arranged to abut the lower edge on the second pane of glass 111 on the second facade element 20 and the upper edge of the second pane of glass 111 on the first facade element 19, respectively. On the outside of the screw 57 there is arranged a sealing 117 which levels the joint between the first main sides 3 on adjacent facade elements 19, 20. The sealing 117 is preferably a sealing compound which may be silicone, but may alternatively be a premanufactured rubber strip. On both sides of the waist 58 on the T-profile there are arranged distance strips 105 of massive polymer, which distance strips have the purpose of absorbing vertical movements of the facade elements 19, 20. The sealing strips 104 may be omitted.

In FIG. 4 there is also shown a space 118 in the bottom of a groove in the distance strip 116 for reception of a portion 59, 63 of the flanges of the profile. The space 118 is arranged to receive water and moist, so that water will not flow over the glass surfaces.

Each one of the parts of the T-profile comprises a contact surface with at least one step in the interface 65 between the first and the second part of the separable T-profile. Thanks to such a contact surface in the interface 65 a well defined contact between the first and the second part is provided when the T-profile is tightened into the building frame using the screw 57.

The separable T-profile allows exchange of a single facade element 2, 19, 20, even if there is arranged facade elements above as well as below the facade element 2, 19, 20, which is to be exchanged. When such a facade element 2, 19, 20, is to be exchanged the profiles of the second kind 35 are removed from both edge sides 29, 45. Then the T-profile in the lower edge side 10 of the facade element which is to be exchanged is removed. The facade element may then be removed and lowered using the grooves in the profiles of the second kind 35 which are arranged below the facade element 2, 19, 20, which is to be exchanged.

Figure 5:
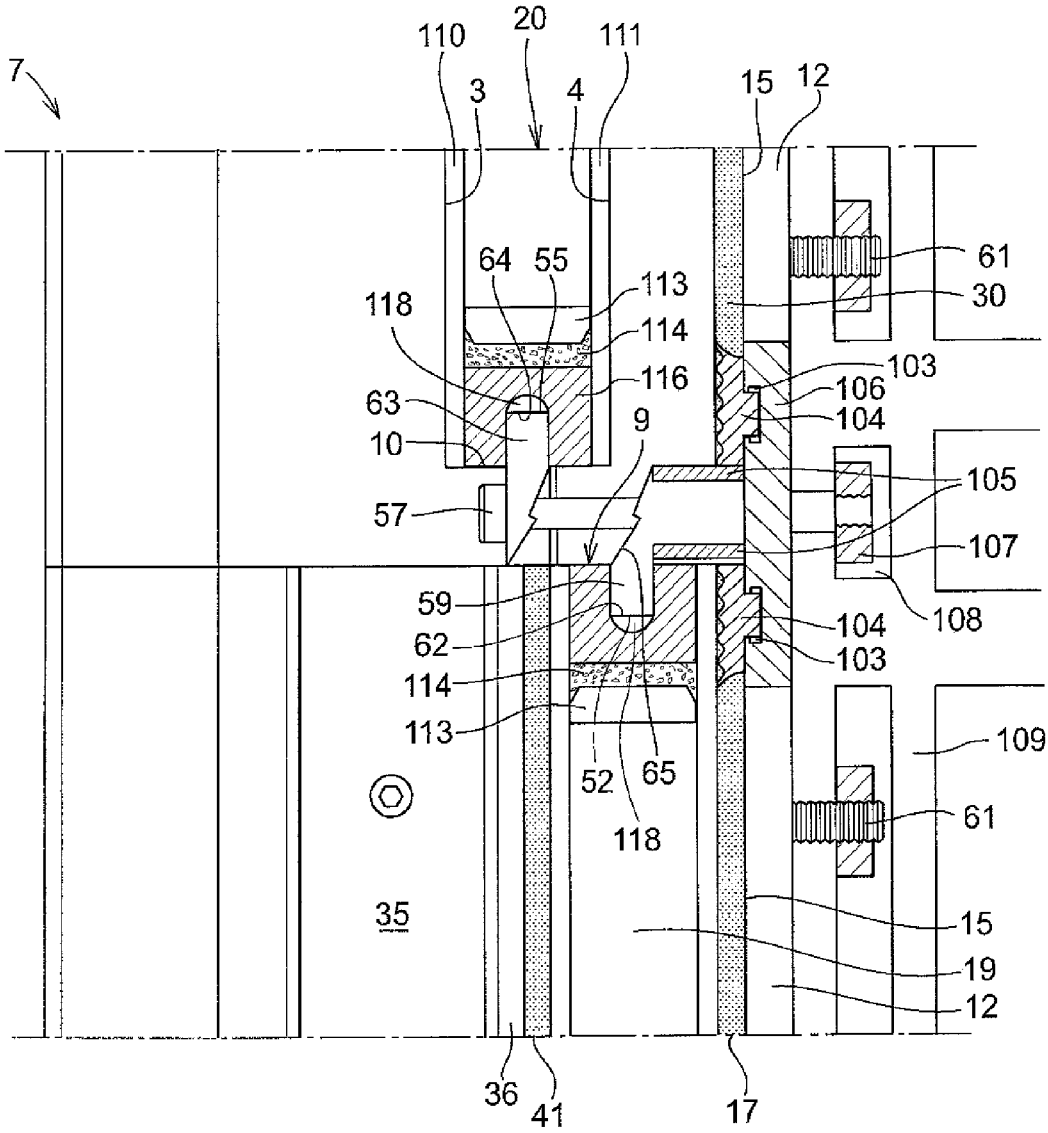
FIG. 5 is a view from the side which shows the fastening of the facade elements in their upper edge and lower edge during mounting/demounting of a facade element.

FIG. 5 is a view from the side which shows how the second facade element 20 may be mounted in the profile system. In FIG. 5 the second facade element has been hoisted from below guided by the grooves in the profiles of the second kind 35 which hold the first facade element 19 in place. In FIG. 5 the upper edge side 9 on the first facade element 19 has been arranged so that the first portion 59 of a flange is arranged in the groove on the upper edge side 9 of the first facade element 19. Then the second part of the separable T-profile has been arranged with its second portion 63 in the groove 55 on the lower edge side 10 of the second facade element 20 and the screw 57 has been inserted through the first part as well as the second part of the separable T-profile. Then the screw 57 is tightened in against the building frame so that also the lower edge side 10 of the second facade element is pressed against the first portion on the profile 7 of the first kind. Finally, the profiles of the second kind 35 are arranged on both edge sides 29, 45, of the second facade element 20. In the opposite way a facade element is dismantled from the profile system. In the figure is also shown a space 118 in the bottom of a groove in the distance strip 116 for reception of a portion 59, 63 of the flanges of the profile. The space 118 is arranged to receive water and moist, so that water will not flow over the glass surfaces.

Figure 6:
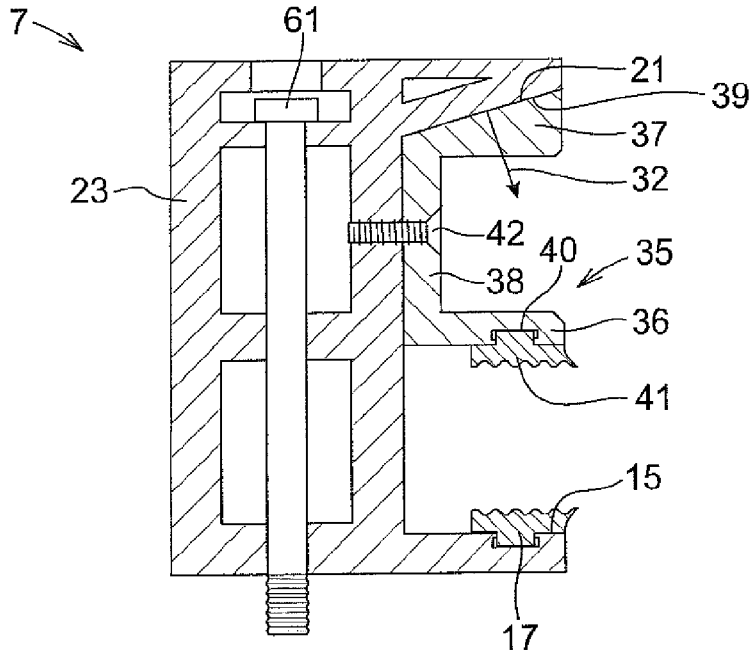
FIG. 6 is a cross-sectional view from above of the profile system according to a second embodiment of the present invention.

FIG. 6 is a cross-sectional view from above of the profile system according to a second embodiment of the present invention. In FIG. 6 the profile of the first kind 7 is arranged for reception of only one facade element. The profile of the first kind does not comprise any rack and neither does the waist comprise any second part 24. The profile of the first kind which is shown in FIG. 6 is in a homogeneous piece.

Figure 7:
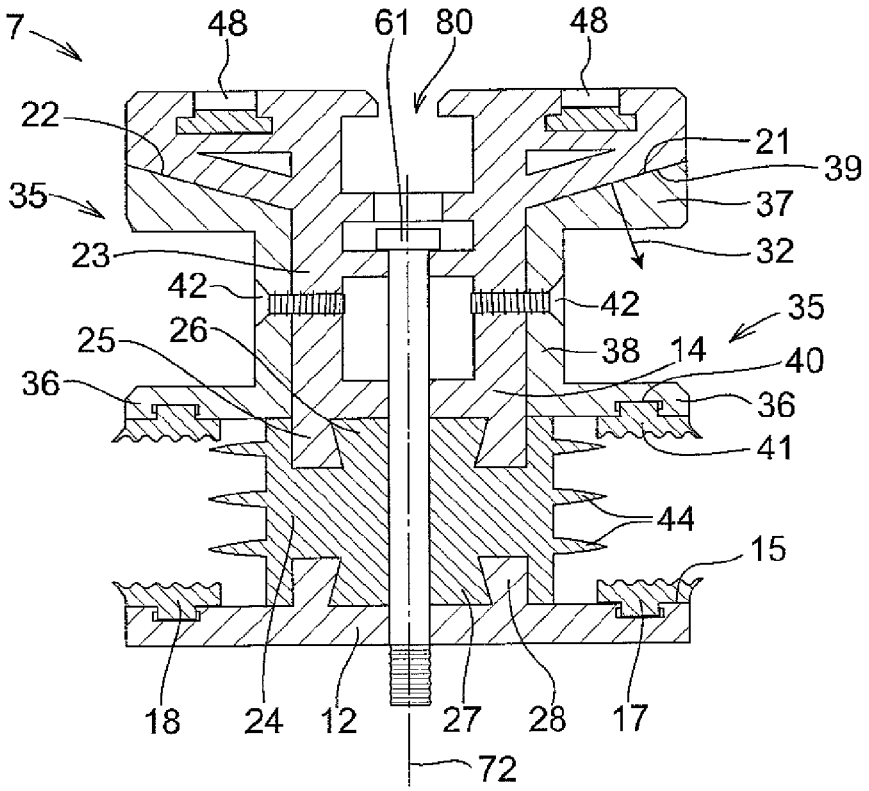
FIG. 7 is a cross-sectional view from above of the profile system according to a third embodiment of the present invention.

FIG. 7 is a cross-sectional view from above of the profile system according to a third embodiment of the present invention. In contrast to the profile of the first kind in FIG. 2 the profile of the first kind in FIG. 7 has only two racks 48 and comprises no supporting profiles 46. Between the racks 48 there is however arranged a groove 80 which may serve as guidance for a hoisting device which is driven upwards using the racks 48. The profile 7 of the first kind which is shown in FIG. 7 has a smaller extension from the building frame than the profile which is shown in FIG. 2.

Figure 8:
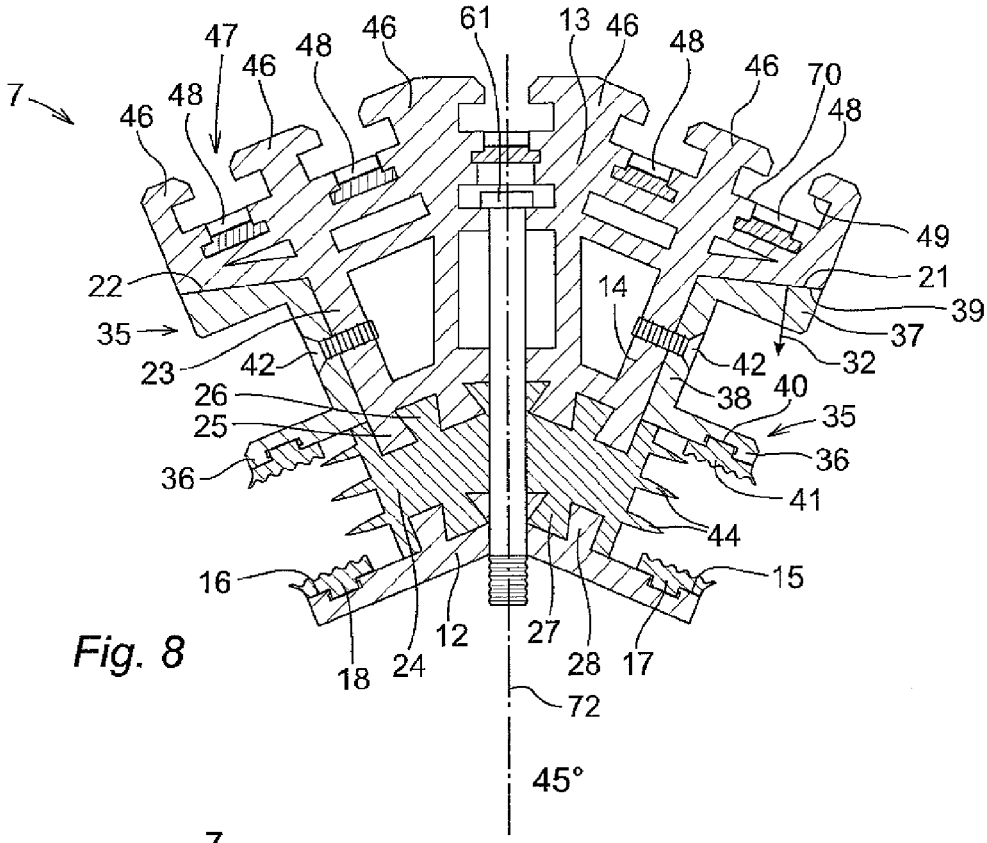
FIG. 8 is a cross-sectional view from above of the profile system according to a fourth embodiment of the present invention.

Profiles of the first kind may be adapted so that they also can be placed between facade elements which are placed in an angle in relation to each other. FIG. 8 is a cross-sectional view from above of the profile system according to a fourth embodiment of the present invention and shows a profile of the first kind which may be placed in corners on a multi-storey building where the facade elements are placed in an angle of 45° in relation to each other with the angle exceeding 180° on the outside of the facade. The profile of the first kind according to the fourth embodiment of the present invention comprises five racks 48.

Figure 9:
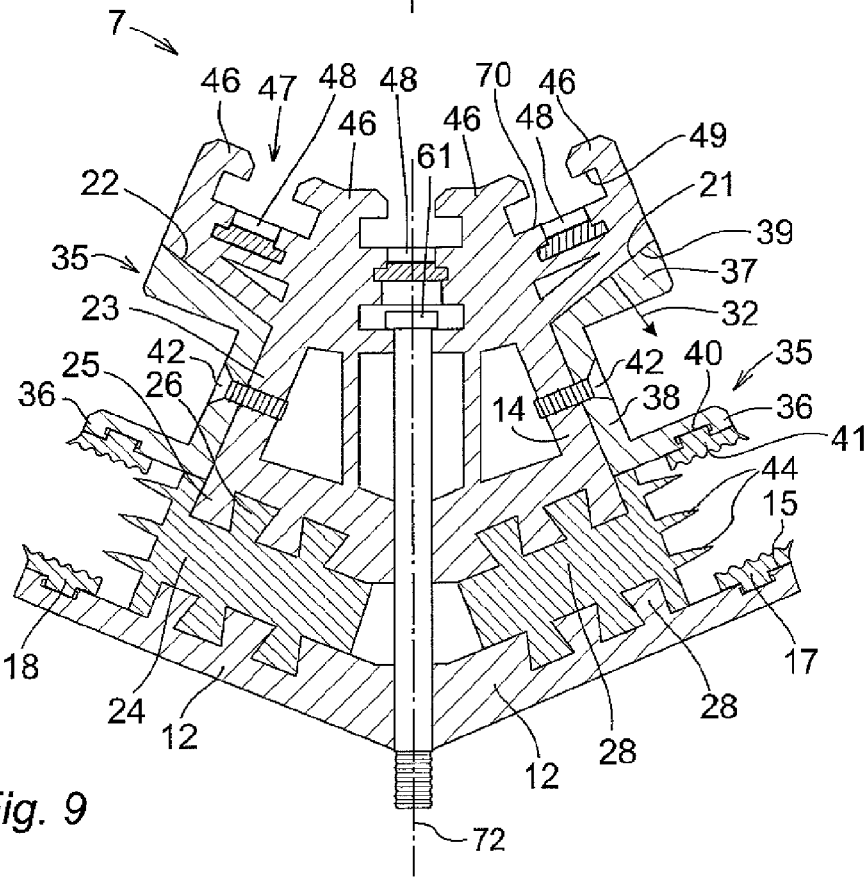
FIG. 9 is a cross-sectional view from above of the profile system according to a fifth embodiment of the present invention.

FIG. 9 is a cross-sectional view from above of the profile system according to a fifth embodiment of the present invention and shows a profile of the first kind which may be placed at corners on a multi-storey building where the facade elements are placed in an angle of 45° in relation to each other with the angle exceeding 180° on the inside of the facade.

Figure 10:
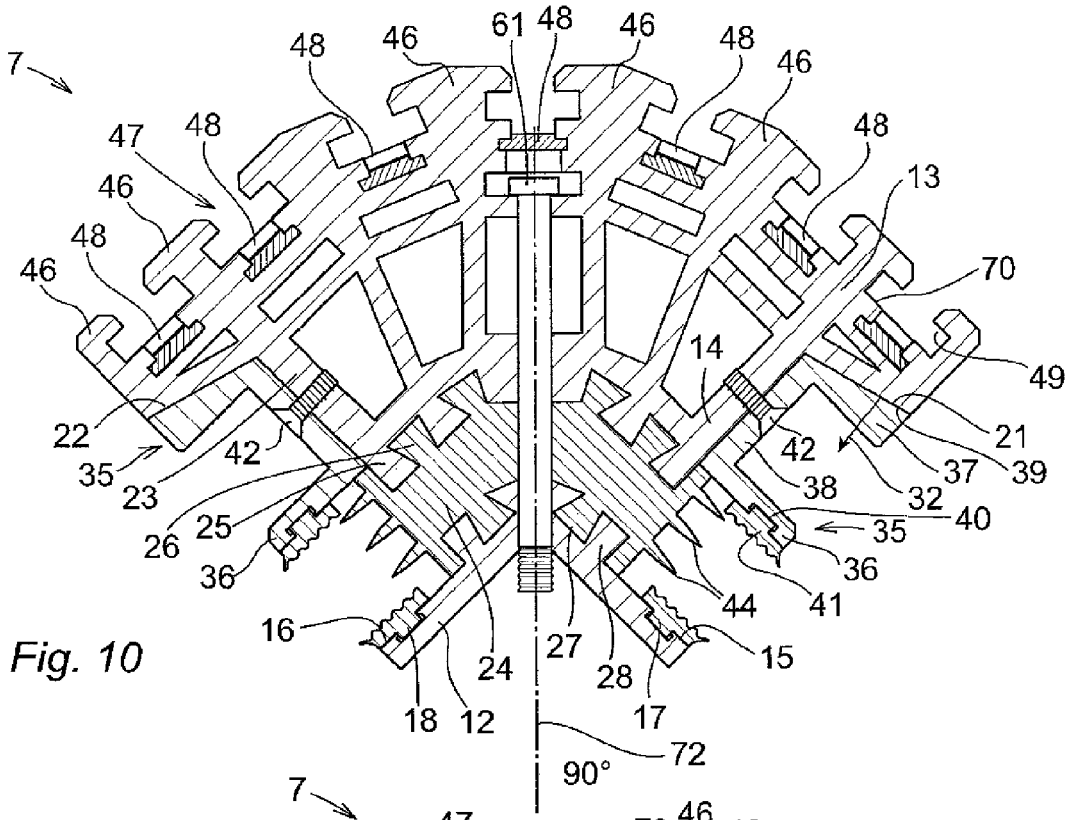
FIG. 10 is a cross-sectional view from above of the profile system according to a sixth embodiment of the present invention.
Figure 11:
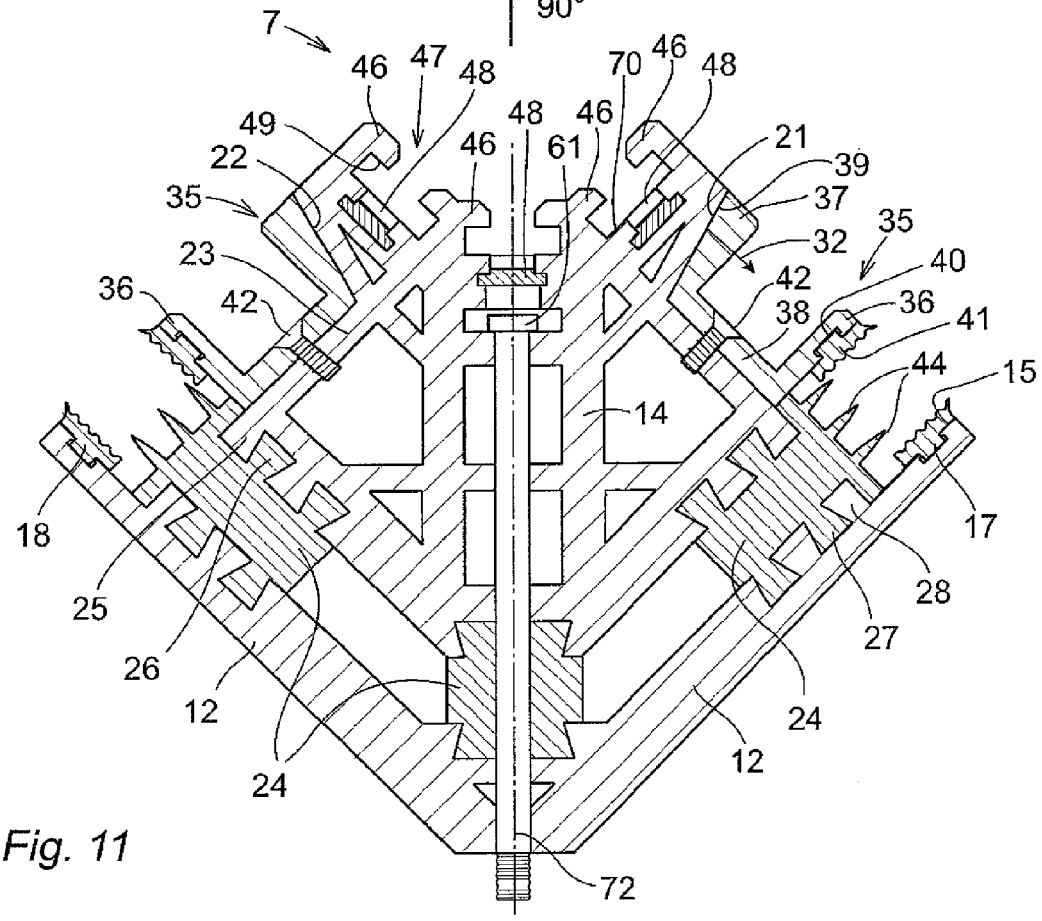
FIG. 11 is a cross-sectional view from above of the profile system according to a seventh embodiment of the present invention.

FIG. 10 is a cross-sectional view from above of the profile system according to a sixth embodiment of the present invention and FIG. 11 is a cross-sectional view from above of the profile system according to a seventh embodiment of the present invention. The embodiments according to FIG. 10 and FIG. 11 are arranged to be placed at right-angled corners on the building.

Figure 12:
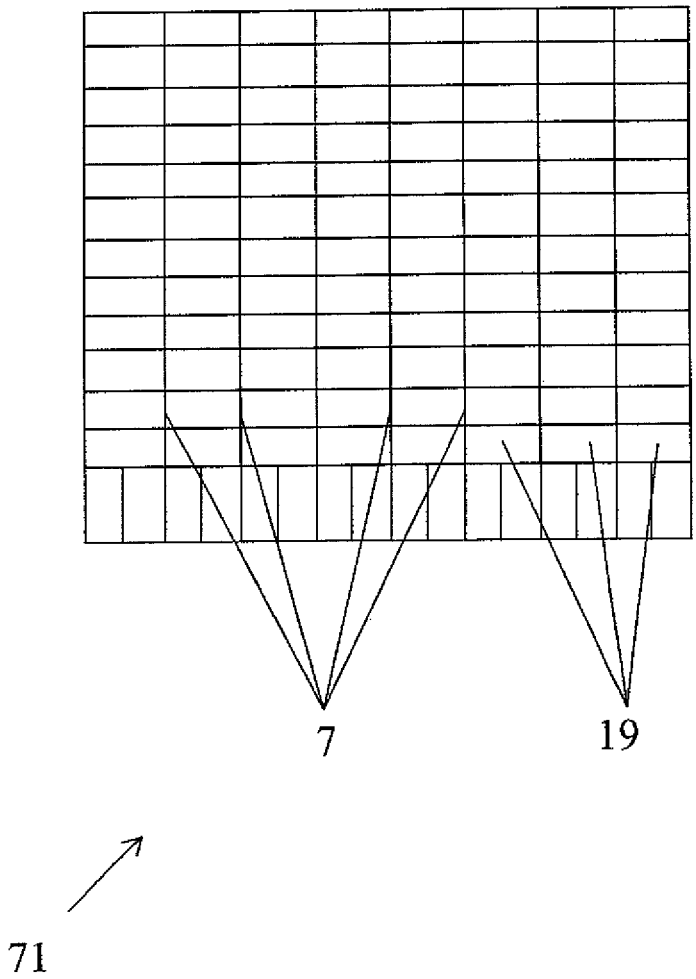
FIG. 12 shows schematically a multi-storey building comprising a building frame and a plurality of profiles of the first kind.

FIG. 12 shows schematically a multi-storey building 71 comprising a building frame 1, a plurality of profiles of the first kind 7 which are arranged vertically on the building frame 1 as well as a plurality of facade elements 19 covering the building frame 1.

Figure 13:
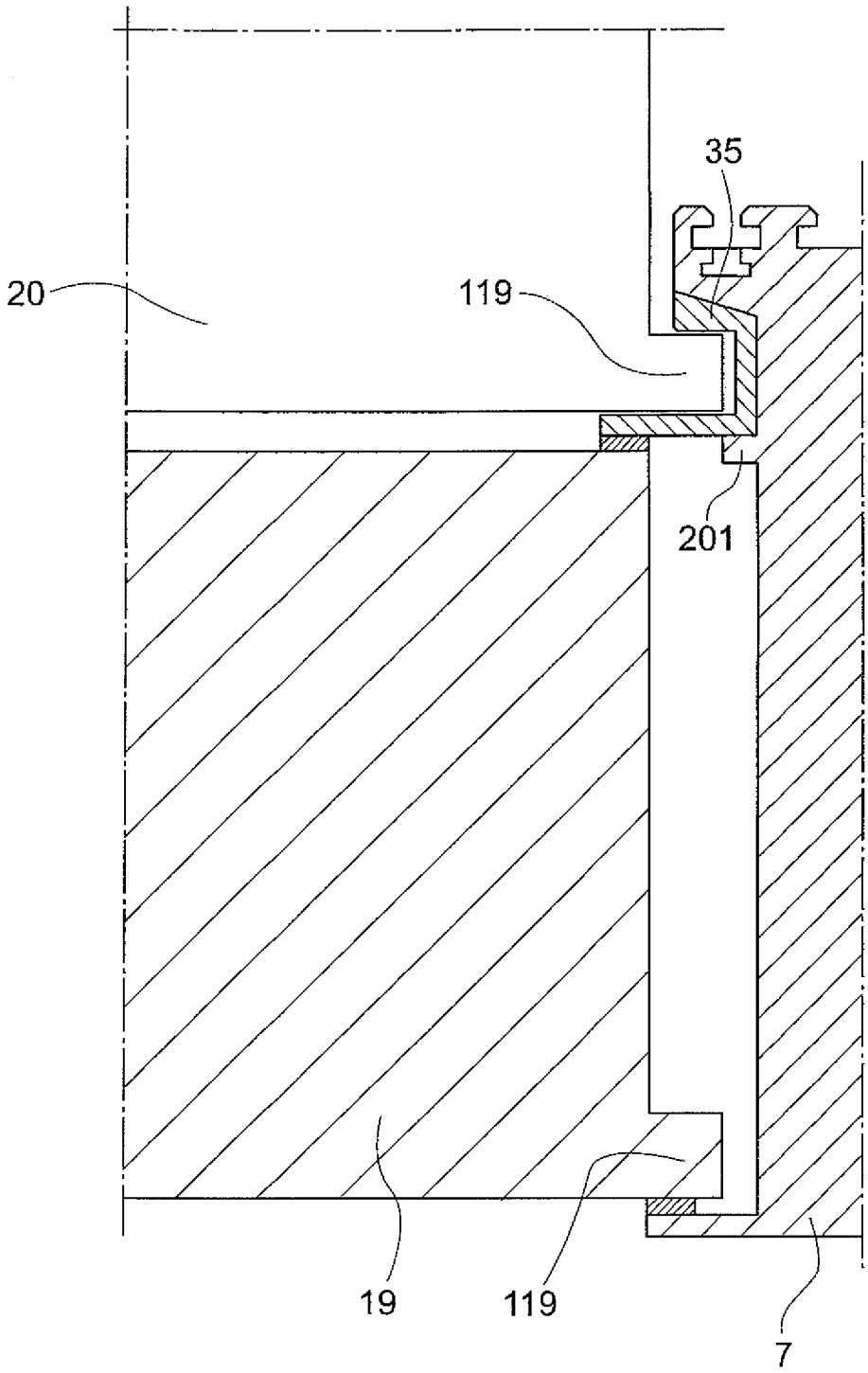
FIG. 13 shows a summary view of a mounted facade element and a facade element during hoisting.

FIG. 13 shows a summary view of a mounted facade element 19 and a facade element 20 during hoisting. The facade element is in this example in the form of a facade cassette comprising a number of separate panes of glass arranged outside each other (not shown in the figures). The facade cassette may be a double shell. The sides of the facade elements 29, 45 (FIG. 2) are provided with a guidance device in the form of an inner flange 119. The width of the inner flange 119 results in that the profile of the second kind 35 may be made shorter than would have been the case if the sides of the facade elements would run with their entire thickness in the groove. For fastening of facade elements in the form of a facade cassette the length on the waist 14 on the profile of the first kind 7 may be adapted. Likewise, the length of the inner part 36 (FIG. 2) of the profile of the second kind 35 may be adapted so that the facade element 19 with the inner flange 119 is well supported. This is especially useful for the cases where the facade elements are double shell elements. On the waist 14 (FIG. 2) on the profile of the first kind there is arranged a heel 201 which gives a more stable fastening of the profile of the second kind 35.

Figure 14:
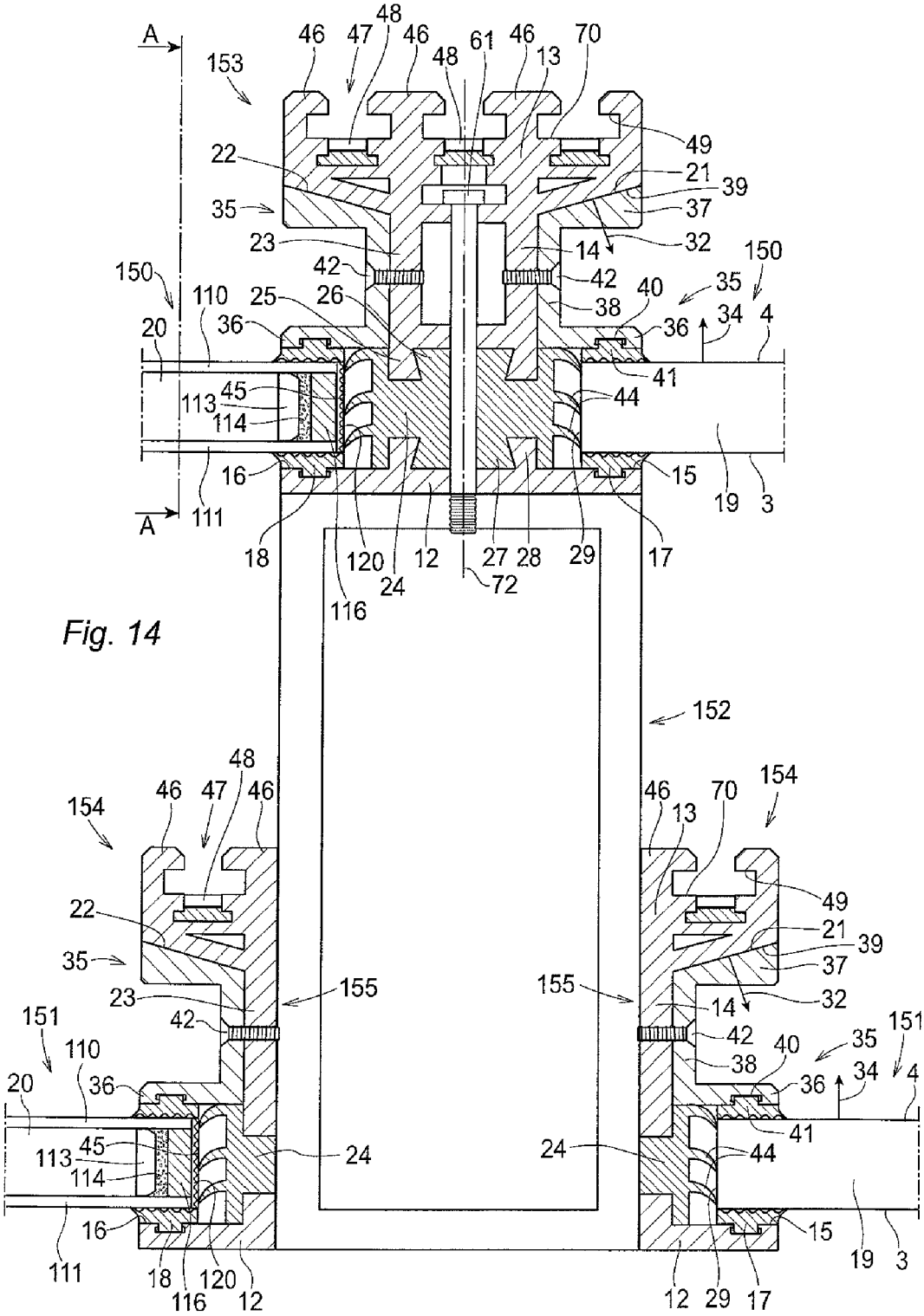
FIG. 14 shows a cross-section of a double shell facade with outer and inner facade elements.

FIG. 14 shows a cross section of a double shell facade with an outer 150 and an inner 151 facade element and an intermediate girder 152. The intermediate girder 152 is only shown schematically and may have different forms. The outer facade elements 150 are in this example supported by a profile system 153 in accordance with the description of FIG. 2. The first portion 12 is arranged to be mounted against the girder 152, which in turn is mounted against the building frame. The inner facade element 151 is supported by a profile system 154 comprising a profile of a first kind 7 and a profile of a second kind 35. The profile of a first kind comprises a first portion 12 arranged to be mounted against the building frame and a portion 155 arranged to be mounted against the girder 152.

The above described embodiments of the invention may be modified in many ways without departing from the spirit and scope of the present invention which is limited only by the appended claims.

According to the described embodiments the facade elements are fastened in the facade using T-profiles in their lower edge sides 10 and their upper edge sides 9. However, it is possible to fasten the facade elements at the lower edge sides 10 and the upper edge sides 9 in other ways known to a man skilled in the art.

The invention claimed is:

1. A profile system for supporting plate formed facade elements on a building frame, wherein the plate formed facade elements have two main sides, two substantially parallel edge sides and a thickness between the main sides perpendicular to the main sides, the profile system comprising:

a profile with a length axis, which profile has a cross section which is substantially constant along the length axis, wherein the profile comprises a first portion comprising a first inner surface and a second portion comprising a first inner surface, which inner surfaces are facing each other, and a first waist which extends from the first portion to the second portion, wherein the first portion is arranged to be mounted against the building frame with the first inner surface of the first portion facing away from the building frame, wherein a facade element is arranged to be supported at one of said parallel edge sides by the first inner surface of the first portion, and an attachment with a length axis, which attachment has a cross section which is substantially constant along the length axis, wherein the attachment comprises a third portion which is arranged to be placed so the third portion supports the facade element, a fourth portion which is arranged to be placed against the first inner surface of the second portion, and a second waist which connects the third portion with the fourth portion, wherein a groove is defined in the attachment by the third portion, the fourth portion and the second waist, wherein a width of the groove is larger than the thickness of the facade element, and wherein the second portion has an outer surface which is facing away from the first inner surface of the second portion, wherein the profile comprises at least one rack which is arranged on the outer surface.

2. The profile system according to claim 1, wherein the first inner surface of the second portion is planar.

3. The profile system according to claim 2, wherein the perpendicular to the first inner surface of the second portion is partially directed away from the first waist of the profile.

4. The profile system according to claim 1, further comprising:

a sealing strip which is arranged on the first inner surface of the first portion in order to seal between the first inner surface of the first portion and the facade element.

5. The profile system according to claim 1, wherein the first portion comprises metal.

6. The profile system according to claim 1, wherein the second portion comprises metal.

7. The profile system according to claim 1, wherein the first waist on the profile at least partially comprises a heat isolating material.

8. The profile system according to claim 7, wherein the first waist on the profile closest to the first portion comprises a heat isolating material.

9. The profile system according to claim 1, wherein said at least one rack is arranged in a groove on the outer surface of the profile.

10. The profile system according to claim 1, wherein the profile comprises a supporting profile which extends from the outer surface of the second portion, which supporting profile comprises a profile surface which is facing towards the outer surface of the second portion.

11. The profile system according to claim 1, wherein the first portion comprises a second inner surface and the second portion comprises a second inner surface, wherein a second facade element is arranged to be supported at one edge side by the second inner surface of the first portion, wherein the first inner surface and second inner surface of the first portion are arranged on opposite sides of the first waist, and wherein the first inner surface and second inner surface of the second portion are arranged on opposite sides of the first waist, which profile system also comprises a second attachment which is arranged to be placed so that the first portion supports the second facade element and the second portion is placed against the second inner surface, on the profile.

12. The profile system according to claim 11, wherein the profile is arranged so that the first facade element and the second facade element substantially end up in the same plane when they are arranged in the profile.

13. The profile system according to claim 11, wherein the profile is arranged so that the first facade element and the second facade element substantially ends up in an angle in relation to each other when they are arranged in the profile.

14. The profile system according to claim 11, wherein the profile is symmetrical with regard to a symmetry axis which extends through the first waist.

15. A profile system for supporting plate formed facade elements on a building frame, wherein the plate formed facade elements have two main sides, two substantially parallel edge sides and a thickness between the main sides perpendicular to the main sides, the profile system comprising:

a profile with a length axis, which profile has a cross section which is substantially constant along the length axis, wherein the profile comprises a first portion comprising a first inner surface and a second portion comprising a first inner surface, which inner surfaces are facing each other, and a first waist which extends from the first portion to the second portion, wherein the first portion is arranged to be mounted against the building frame with the first inner surface of the first portion facing away from the building frame, wherein a facade element is arranged to be supported at one of said parallel edge sides by the first inner surface of the first portion, and an attachment with a length axis, which attachment has a cross section which is substantially constant along the length axis, wherein the attachment comprises a third portion which is arranged to be placed so the third portion supports the facade element, a fourth portion which is arranged to be placed against the first inner surface of the second portion, and a second waist which connects the third portion with the fourth portion, wherein a groove is defined in the attachment by the third portion, the fourth portion and the second waist, wherein a width of the groove is larger than the thickness of the facade element, and wherein the groove has a substantially U-formed cross section, wherein the second waist of the attachment is arranged to rest against the first waist of the profile in the mounted position.

16. A profile system for supporting plate formed facade elements on a building frame, wherein the plate formed facade elements have two main sides, two substantially parallel edge sides and a thickness between the main sides perpendicular to the main sides, the profile system comprising:

a profile with a length axis, which profile has a cross section which is substantially constant along the length axis, wherein the profile comprises a first portion comprising a first inner surface and a second portion comprising a first inner surface, which inner surfaces are facing each other, and a first waist which extends from the first portion to the second portion, wherein the first portion is arranged to be mounted against the building frame with the first inner surface of the first portion facing away from the building frame, wherein a facade element is arranged to be supported at one of said parallel edge sides by the first inner surface of the first portion, and an attachment with a length axis, which attachment has a cross section which is substantially constant along the length axis, wherein the attachment comprises a third portion which is arranged to be placed so the third portion supports the facade element, a fourth portion which is arranged to be placed against the first inner surface of the second portion, and a second waist which connects the third portion with the fourth portion, wherein a first groove is defined in the attachment by the third portion, the fourth portion and the second waist, wherein a width of the first groove is larger than the thickness of the facade element, and wherein a width of a second groove between the first portion and the second portion is smaller than the thickness of the facade element, but larger than the width of a protruding flange on the facade element.

17. A profile system for supporting plate formed facade elements on a building frame, wherein the plate formed facade elements have two main sides, two substantially parallel edge sides and a thickness between the main sides perpendicular to the main sides, the profile system comprising:

a profile with a length axis, which profile has a cross section which is substantially constant along the length axis, wherein the profile comprises a first portion comprising a first inner surface and a second portion comprising a first inner surface, which inner surfaces are facing each other, and a first waist which extends from the first portion to the second portion, wherein the first portion is arranged to be mounted against the building frame with the first inner surface of the first portion facing away from the building frame, wherein a facade element is arranged to be supported at one of said parallel edge sides by the first inner surface of the first portion, an attachment with a length axis, which attachment has a cross section which is substantially constant along the length axis, wherein the attachment comprises a third portion which is arranged to be placed so the third portion supports the facade element, a fourth portion which is arranged to be placed against the first inner surface of the second portion, and a second waist which connects the third portion with the fourth portion, wherein a first groove is defined in the attachment by the third portion, the fourth portion and the second waist, wherein a width of the first groove is larger than the thickness of the facade element, and wherein the plate formed facade element comprises an upper edge side and the lower edge side which are substantially parallel to each other and which comprise second grooves, and a separable T-profile which has a length axis and a substantially constant cross section along the length axis, and which is arranged to interact with the second grooves in the upper edge side and the lower edge side, wherein a first part of the separable T-profile comprises a waist and a first portion of a flange which first portion extends from a first flange edge to the waist, wherein a second part of the separable T-profile comprises a second portion of the flange, which portion extends from a second flange edge to the waist, and wherein the waist extends from the flange away from the flange, wherein the first and second parts in the separable T-profile are arranged to be fastened in the building frame by at least one screw which extends through the first part of the T-profile and the second part of the T-profile and through the waist of the T-profile, wherein each one of the parts of the T-profile comprises a contact surface with at least one step in the interface between the first and the second part of the separable T-profile.

18. The profile system according to claim 17, wherein the upper edge side and the lower edge side are arranged to be placed substantially horizontally.

19. A facade system, comprising:

plate formed facade elements, and a profile system for supporting plate formed facade elements on a building frame, wherein the plate formed facade elements have two main sides, two substantially parallel edge sides and a thickness between the main sides perpendicular to the main sides, the profile system comprising:

a profile with a length axis, which profile has a cross section which is substantially constant along the length axis, wherein the profile comprises a first portion comprising a first inner surface and a second portion comprising a first inner surface, which inner surfaces are facing each other, and a first waist which extends from the first portion to the second portion, wherein the first portion is arranged to be mounted against the building frame with the first inner surface of the first portion facing away from the building frame, wherein a facade element is arranged to be supported at one of said parallel edge sides by the first inner surface of the first portion, and an attachment with a length axis, which attachment has a cross section which is substantially constant along the length axis, wherein the attachment comprises a third portion which is arranged to be placed so that the third portion supports the facade element, a fourth portion which is arranged to be placed against the first inner surface of the second portion, and a second waist which connects the third portion with the fourth portion, wherein a first groove is defined in the attachment by the third portion, the fourth portion and the second waist, wherein a width of the first groove between the first portion and the second portion is larger than the thickness of the facade element, and wherein a width of a second groove between the first portion and the second portion is smaller than the thickness of the facade element, but larger than the width of a protruding flange on the facade element.

20. The facade system according to claim 19, further comprising: outer and inner facade elements.

21. A building frame for multi-story buildings, the building frame comprising:

a profile system for supporting plate formed facade elements on a building frame, wherein the plate formed facade elements have two main sides, two substantially parallel edge sides and a thickness between the main sides perpendicular to the main sides, the profile system comprising:

a profile with a length axis, which profile has a cross section which is substantially constant along the length axis, wherein the profile comprises a first portion comprising a first inner surface and a second portion comprising a first inner surface, which inner surfaces are facing each other, and a first waist which extends from the first portion to the second portion, wherein the first portion is arranged to be mounted against the building frame with the first inner surface of the first portion facing away from the building frame, wherein a facade element is arranged to be supported at one of said parallel edge sides by the first inner surface of the first portion, and an attachment with a length axis, which profile has a cross section which is substantially constant along the length axis, wherein the attachment comprises a third portion which is arranged to be placed so that the third portion supports the facade element, a fourth portion which is arranged to be placed against the first inner surface of the second portion on the profile, and a second waist which connects the third portion with the fourth portion, wherein a first groove is defined in the attachment by the third portion, the fourth portion and the second waist, wherein a width of the first groove is larger than the thickness of the facade element, and wherein a width of a second groove between the first portion and the second portion is smaller than the thickness of the facade element, but larger than the width of a protruding flange on the facade element.

22. The building frame according to claim 21, wherein the profile system comprises at least two profiles, which are arranged with their length axes parallel to each other, wherein the at least two profiles are arranged for reception of a facade element between them.

23. A multi-story building, comprising:

a building frame a profile system for supporting plate formed facade elements on a building frame, wherein the plate formed facade elements have two main sides, two substantially parallel edge sides and a thickness between the main sides perpendicular to the main sides, the profile system comprising:

a profile with a length axis, which profile has a cross section which is substantially constant along the length axis, wherein the profile comprises a first portion comprising a first inner surface and a second portion comprising a first inner surface, which inner surfaces are facing each other, and a first waist which extends from the first portion to the second portion, wherein the first portion is arranged to be mounted against the building frame with the first inner surface of the first portion facing away from the building frame, wherein a facade element is arranged to be supported at one of said parallel edge sides by the first inner surface of the first portion, and an attachment with a length axis, which profile has a cross section which is substantially constant along the length axis, wherein the attachment comprises a third portion which is arranged to be placed so that the third portion supports the facade element, a fourth portion which is arranged to be placed against the first inner surface of the second portion on the profile, and a second waist which connects the third portion with the fourth portion, wherein a first groove is defined in the attachment by the third portion, the fourth portion and the second waist; and a plurality of facade elements arranged on the building frame, wherein a width of the first groove between the first portion and the second portion is larger than the thickness of the facade element, and wherein a width of a second groove between the first portion and the second portion is smaller than the thickness of the facade element, but larger than the width of a protruding flange on the facade element.

24. A method for arrangement of plate formed facade elements on a building frame, wherein the plate formed facade elements have two main sides, two substantially parallel edge sides and a thickness between the main sides perpendicularly to the main sides, the method comprising:

arranging at least a first profile and a second profile, which profiles each comprise a length axis, on a building frame with their length axes parallel, and which have a cross section which is substantially constant along the length axis, wherein the profiles comprise a first portion comprising a first inner surface and a second portion comprising a first inner surface, which inner surfaces are facing each other, and a first waist which extends from the first portion to the second portion, wherein the first portion is arranged against the building frame with the first inner surface of the first portion facing away from the building frame, arranging a facade element so that the façade element is supported at one edge side by the first inner surface of the first portion and at another edge side by the first inner surface of the first portion on the second profile, arranging an attachment, which attachment has a length axis and a cross section which is substantially constant along the length axis, at each one of the profiles, wherein the attachments comprise a third portion which is placed so that the third portion supports the facade element, a fourth portion which is placed against the first inner surface of the second portion on the profile, and a second waist which connects the third portion with the fourth portion, wherein a first groove is defined in the attachment by the third portion, the fourth portion and the second waist, and hoisting the second facade element in the first groove which supports the first facade element, wherein a width of the first groove is larger than the thickness of the facade element.

25. The method according to claim 24, wherein the plate formed facade elements comprises an upper edge side and a lower edge side which are substantially parallel to each other and which comprise third grooves.

26. The method according to claim 25, further comprising before the arrangement of the facade element arranging a first separable T-profile in the lower edge of the facade element, which T-profile has a length axis and a substantially constant cross section along the length axis, and which is arranged to interact with the third grooves in the upper edge side and the lower edge side, wherein a first part of the separable T-profile comprises a third waist and a first portion of a flange which first portion extends from a first flange edge to the third waist, wherein a second part of the separable T-profile comprises a second portion of the flange, which portion extends from a second flange edge to the third waist, and wherein the third waist extends from the flange away from the flange, so that the first portion of the flange is directed upwards, arranging a first part of a second separable T-profile, which has the same construction as the first separable T-profile, in the upper edge of the facade element, so that the first portion of the flange is directed upwards, arranging the first portion of the flange on the first separable T-profile in the third groove in the lower edge of the facade element, during arrangement of the facade element, and arranging the second part of the second separable T-profile, so that the second portion of the flange on the second separable T-profile is placed in the third groove in the upper edge of the facade element, after arrangement of the facade element.

27. The method according to claim 26, further comprising:

arranging a second facade element so that the first portion of the flange on the second separable T-profile is placed in the third groove in the lower edge of the second facade element.

28. A method for arrangement of plate formed facade elements on a building frame, wherein the plate formed facade elements have two main sides, two substantially parallel edge sides and a thickness between the main sides perpendicularly to the main sides, the method comprising:

arranging at least a first profile and a second profile, which profiles each comprise a length axis, on a building frame with their length axes parallel, and which have a cross section which is substantially constant along the length axis, wherein the profiles comprise a first portion comprising a first inner surface and a second portion comprising a first inner surface, which inner surfaces are facing each other, and a first waist which extends from the first portion to the second portion, wherein the first portion is arranged against the building frame with the first inner surface of the first portion facing away from the building frame, arranging a facade element so that the façade element is supported at one edge side by the first inner surface of the first portion and at another edge side by the first inner surface of the first portion on the second profile, and arranging an attachment, which attachment has a length axis and a cross section which is substantially constant along the length axis, at each one of the profiles, wherein the attachments comprise a third portion which is placed so that the third portion supports the facade element, a fourth portion which is placed against the first inner surface of the second portion on the profile, and a second waist which connects the third portion with the fourth portion, wherein a groove is defined in the attachment by the third portion, the fourth portion and the second waist, and wherein a width of the groove is larger than the thickness of the facade element, and wherein the second portion has an outer surface which is facing away from the first inner surface of the second portion, wherein the profile comprises at least one rack which is arranged on the outer surface, and wherein the facade elements are transported to the correct height by using the rack.

* * * * *

UNITED STATES PATENT AND TRADEMARK OFFICE

CERTIFICATE OF CORRECTION

PATENT NO. : 8,555,576 B2
APPLICATION NO. : 12/864588
DATED : October 15, 2013
INVENTOR(S) : Jon H. Falk It is certified that error appears in the above-identified patent and that said Letters Patent is hereby corrected as shown below:

Title Page: Item (73) Assignee should read:

Brunkeberg ~~Industriutveckling~~ Industriutveckling AB, Stockholm (SE)

Title Page: Item (30) Foreign Application Priority Data should read:

Jan. 25, 2008 (SE).....0800184-4

Signed and Sealed this
Seventeenth Day of December, 2013

Margaret A. Focarino

Margaret A. Focarino
*Commissioner for Patents of the United States Patent and Trademark Office*